United States Patent [19]

Gerber

[11] Patent Number: 4,712,836

[45] Date of Patent: Dec. 15, 1987

[54] LEG REST FOR BELOW KNEE AMPUTEE

[76] Inventor: James R. Gerber, 1171 Ringling Ave., Johnstown, Pa. 15902

[21] Appl. No.: 789,662

[22] Filed: Oct. 21, 1985

[51] Int. Cl.[4] ..... A47C 7/52

[52] U.S. Cl. ..... 297/429; 297/423; 297/433

[58] Field of Search ..... 297/429, 433, 427, 423, 297/DIG. 4, 431, 435, 437; 248/286, 298, 411, 412, 291; 403/104, 383

[56] References Cited

U.S. PATENT DOCUMENTS

| | | | |
|---|---|---|---|
| 1,734,576 | 11/1929 | Hamilton et al. | 297/435 |
| 2,486,685 | 11/1949 | Schneeman | 248/298 X |
| 2,710,207 | 6/1955 | Mueller | 248/411 X |
| 2,733,082 | 1/1956 | Backhouse | 248/298 X |
| 2,746,527 | 5/1956 | Liebich | 297/433 |
| 3,072,437 | 1/1963 | Shea et al. | 297/435 |
| 3,195,848 | 7/1965 | Miller et al. | 248/411 |
| 3,212,817 | 10/1965 | Sully | 297/429 |
| 3,861,745 | 1/1975 | Forrest | 297/429 X |
| 4,111,575 | 9/1978 | Hoshino | 403/104 |
| 4,176,879 | 12/1979 | Rodaway | 297/429 |
| 4,572,577 | 2/1986 | La Rue | 297/DIG. 4 |

FOREIGN PATENT DOCUMENTS

| | | | |
|---|---|---|---|
| 615095 | of 1961 | Italy | 403/383 |
| 119613 | 10/1918 | United Kingdom | 297/429 |

*Primary Examiner*—Peter A. Aschenbrenner
*Assistant Examiner*—Mark W. Binder

[57] ABSTRACT

An improved swing away stump rest for below the knee (BK) amputees to maintain comfort and proper positioning of the stump to assist in preventing knee flexion contracture of the amputated limb and edema in the stump. The swing away feature provides for maximum safety and convenience when transferring.

4 Claims, 4 Drawing Figures

LEG REST FOR BELOW KNEE AMPUTEE

This invention relates to wheel chairs. More particularly, this invention relates to an improved stump rest attachment on a wheel chair particularly useful for a person with a below the knee (BK) amputation.

It is now common practice to equip and provide wheel chairs with leg and/or foot rests which may be adjusted by varying degrees and by varying methods to support the member in a horizontal position and to enhance the comfort of the user.

Patients with amputated legs, when sitting, require a horizontal support for the remaining portion of the leg or legs to insure proper blood circulation. Additionally, one of the primary concerns for rehabilitation specialists working with below the knee (BK) amputees is the prevention of the condition known as knee flexion contracture, a condition which prevents the BK patient from fully extending or straightening the knee and, when occurring, tends to delay the expedient application of prosthetic devices.

A knee flexion contracture is easily developed to BK amputees by sitting in a wheel chair with the BK stump in the normally flexed sitting position. This is a rather common occurrence and has been dealt with in the past by the use of an "amputee board". This so-called "board" encompasses the entire seat with an extension to help support the BK stump.

Boards featuring a means for collapsing the unit have been also used. U.S. Pat. No. 3,861,745 to Forrest describes such a unit where collapsing is accomplished by releasing a hinge means. Such means are awkward, the patient faced with bending forward and down to raise the hinged portion to a position where locking of the unit may be undertaken.

Attempts to overcome the disadvantages of the board attachments for wheelchairs have been made. U.S. Pat. No. 3,189,384 to Bliss describes an adjustable leg rest which is attached to the leg support of the wheel chair. While allowing for horizontal adjustments to accommodate various lengths of stumps, the apparatus, as in U.S. Pat. No. 3,861,745, collapses downward. Further, the rest may be adjusted horizontally at a limited number of defined positions only. A similar apparatus presenting the same negative features is disclosed in U.S. Pat. No. 3,301,595 to Jennings.

Such devices are inherently burdensome and, to a degree, dangerous when the user is moving to and from the board-equipped wheel chair.

It is an object of the present invention to provide an adjustable support for a BK stump.

A further object of the present invention is to provide an adjustable BK stump support which may be used with a wheel chair to provide horizontal support for the BK stump and permit easy release and removal of the supporting section when the patient arises from the wheel chair.

A yet further object of the invention is to provide a BK stump rest assemblage which can be used for either right or left BK amputees and which can be easily swung out of the way by a simple pivoting motion.

These and other objects are provided for by the present invention which relates to an adjustable wheel chair-mounted stump rest comprising, in combination, a vertical tube having situated thereon means for securing the tube to a wheel chair, a horizontal tube permanently attached to the vertical tube at or near the top thereof, the horizontal tube having at least one longitudinal ridge or groove extending substantially the length of the tube, a cylindrical sleeve slideably mounted on the horizontal tube, the sleeve having a transverse channel communicating with the horizontal tube, the channel adapted to receive and retain an adjustable locking means, the locking means securing the sleeve to the horizontal tube, and the sleeve further having means situated thereon for attachment to a stump rest panel.

Further objects of this invention will become apparent by reference to the accompanying detailed description and the drawings in which FIG. 1 is an exploded view of the basic components making up the stump rest;

DETAILED DESCRIPTION OF THE DRAWINGS

Figure 1:
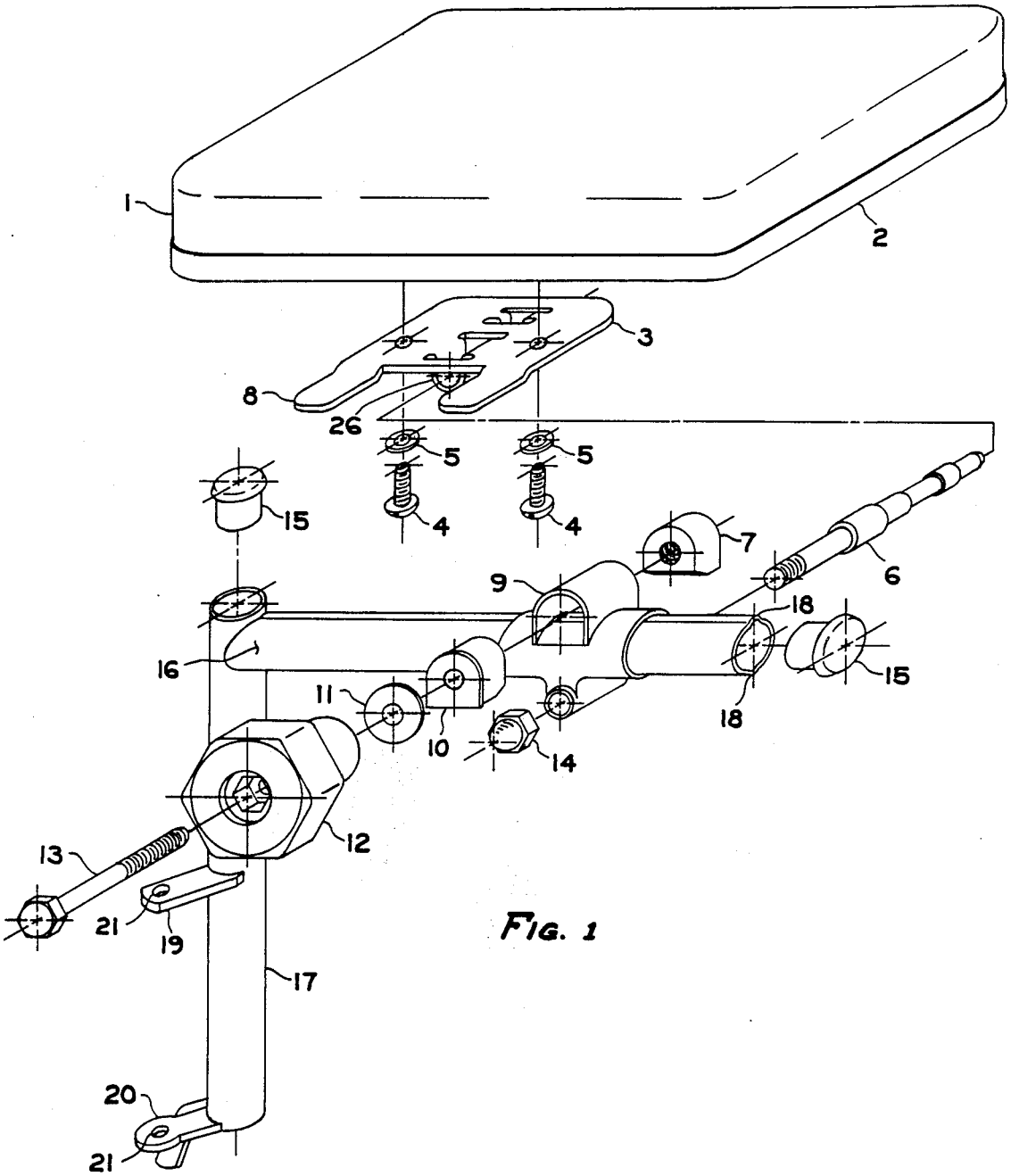

Referring to the drawings, FIG. 1 illustrates the device in exploded depiction. A padded stump rest panel 1 is fastened to a stump rest panel base 2 with a plate 3 fastened to the underside thereof by means of bolts 4 and lock washers 5. Plate 3 is provided with a pair of extended lugs 8 and a pair of U-shaped lugs 26 bent downward to provide for reception of securing pin 6, the extended lugs 8 serving to maintain the stump rest panel assembly in parallel relationship with horizontal tube 16. Securing pin 6 is inserted through slide sleeve 9 on horizontal tube 16 and U-shaped lugs on plate 3 with securing pin 6 held in place with cap nut 14, which attaches the assembled panel to horizontal tube 16.

Horizontal tube 16 is permanently attached to the top of vertical tube 17, by welding or other means, vertical tube 17 providing the attachment means for the entire assemblage 22 to a wheel chair. Brackets 19 and 20, with holes 21, are attached to vertical tube 17 to provide means for attaching the assemblage to a wheel chair, and are variably situated and sized depending upon the particular type of wheel chair to be used.

The particular means employed to attach the rest to the wheel chair may be varied, according to the particular wheel chair to be used, and may provide for easily removable or semi-permanent attachment. For example, assemblage may be effected by providing permanently attached horizontal plates, having holes therethrough, on a wheel chair, matching plates on the vertical tube, and securing the rest to the leg of the chair by placing the tube plates on the leg plates, aligning the holes, and passing a pin or bolt through the aligned holes, with suitable means for securing the positioned stump rest in a locked position. The design of the attachment means may be such as to allow the stump rest to be secured to a standard wheel chair by removing the foot rest from the mounting means on the wheel chair frame and replacing it with the stump rest. An attachment means with a locking feature is depicted in FIG. 4.

Figure 4:
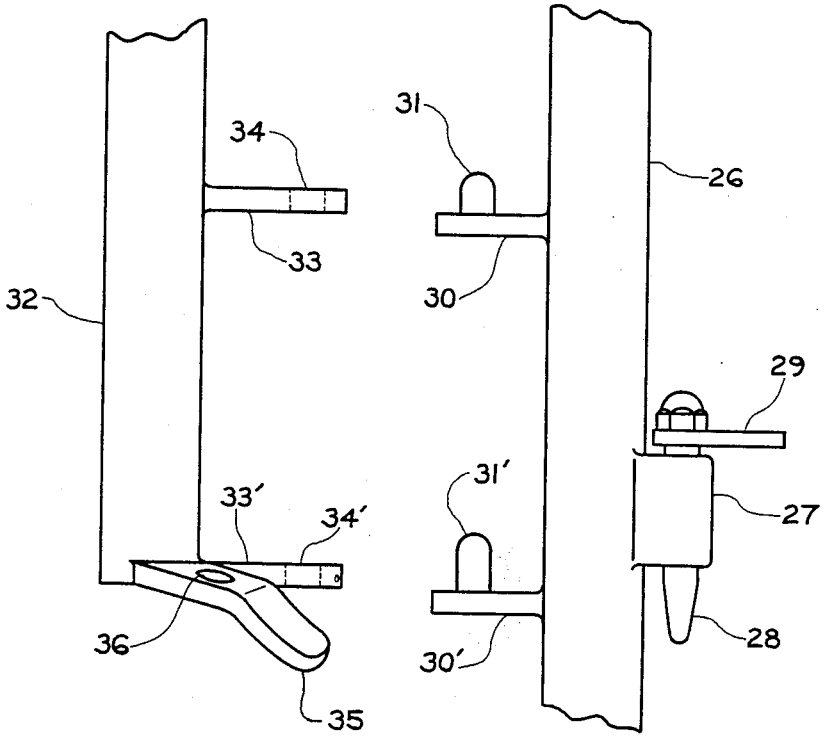
FIG. 4 is a front view of a disassembled suitable wheel chair attachment means.

In FIG. 4, 26 represents the right front vertical frame member of a wheel chair. Extending from 26 are two horizontal plates 30 and 30', having situated thereon vertical posts 31 and 31'. Mounted on the opposing side of frame member 26 is a permanently attached sleeve 27, containing a downwardly biased spring-held pin 28 extending above sleeve 27 to a handle 29 and a short distance below sleeve 28.

The vertical tube 32 of the stump rest in this particular instance is provided with two horizontal plates 33 and 33', each having through holes 34 and 34', near the distal end, of a size to permit seating on plates 30 and 30' by means of pins 31 and 31'.

A downwardly sloping rider bar 35 extends from the tube 32 at a point essentially in the same plane as horizontal bar 33', bar 35 provided with opening 36 near the proximal end thereof.

In attaching the stump rest to a wheel chair having attaching and seating means as described, plates 33 and 33' are secured to frame member 26 by aligning and seating through-holes 34 and 34' on posts 31 and 31'. Rotation of vertical tube 32 to the right, in the arrangement of FIG. 4, allows pin 28 to be moved upwardly on rider bar 35 until pin 28 is aligned with opening 36, the spring means in sleeve 27 forcing pin 28 into locking engagement with opening 36, securing the stump rest in a locked position. Disengagement of the locked position is accomplished easily by simply lifting pin 28 by means of handle 29, moving the stump rest unit outwardly from the locking position. Obviously, pin 28 could operate without spring means, as a drop-pin.

Slide sleeve 9 is a cylindrical tube with a transverse U-shaped opening on top for reception of a knob locking device and a transverse tubular attachment on the bottom for receiving pin 6.

The knob locking device shown consists of knob 12, clasp bolt 13, washer 11, flanged clamp 10 and threaded clamp 7.

Locking of the stump rest in a selected position along horizontal tube 16 is accomplished simply by rotating knob 12 to move clamps 7 and 10 into frictional engagement with tube 16. Obviously, if desired, clamping member 10 may also be internally threaded. Reverse rotation of knob 12 disengages the clamping members 7 and 10, allowing the stump rest to be swung down and out of the way of the user.

Horizontal tube 16 is provided with at least one longitudinally extending ridge or groove 18 (upper and lower ridges depicted) to prevent the assembled stump rest panel from rotating about horizontal tube 16 when in the locked position.

Optional caps 15 function to cover the top opening of vertical tube 17 and the end opening of horizontal tube 16.

Figure 2:
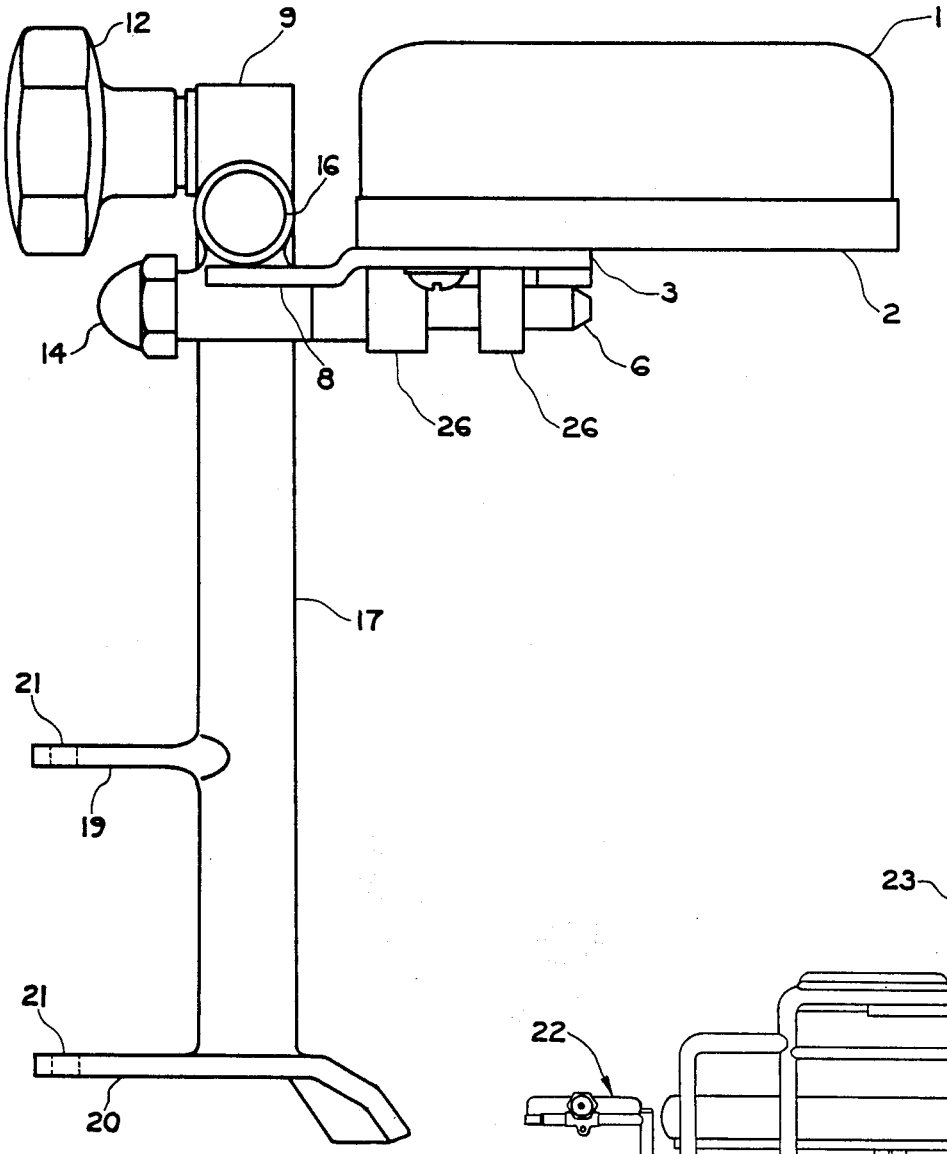
FIG. 2 is a front view of the stump rest.

FIG. 2 illustrates a frontal view of the assembled stump rest, wherein padded stump rest panel 1, and the stump rest panel base 2 are attached to horizontal tube 16 by means of securing pin 6 and lugs 26 and rotatably secured thereon by means of the knob locking device operating through slide sleeve 9.

Figure 3:
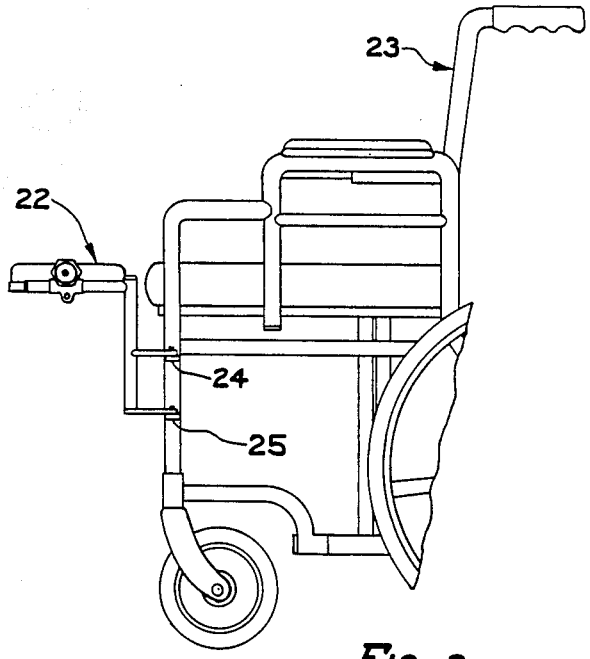
FIG. 3 is a side view of the stump rest attached to a wheel chair.

Referring to FIG. 3, a wheel chair of conventional construction is denoted as 23, with attachment of the stump rest assemblage 22 to the wheel chair by means of varingly situated and sized attachment means 24 and 25, the attachment means variable depending, of course, upon the specified securing brackets utilized by the individual wheel chair manufacturer.

The stump rest of the present invention is therefore seen to provide the necessary support for the stump, with adjustability lengthwise providing for the accommodation of varying degrees of amputation, for both left and right amputations and with the desirable feature of adjustment facilitating the movement of the amputee to and from the stump rest-equipped wheel chair.

The stump rest panel may be cushioned with a resilient padding such as foam rubber, covered with a suitable protective material, such as fabric or the like.

It is to be understood that various changes may be made in the form and arrangements of the present invention without departing from the scope thereof, with the terminology used for the purposes of description and not of limitation, and the scope of the invention being defined by the appended claims.

What is claimed is:

1. An adjustable stump rest for attachment to a wheel chair suitable, when attached to said wheel chair, for use by below-the-knee amputees, said stump rest comprising, in combination:

a stump rest panel;

a vertical tube having situated thereon means for securing said tube to said wheel chair;

a horizontal tube permanently attached to said vertical tube at or near the top thereof, said horizontal tube having at least one longitudinal ridge extending substantially the length thereof and one longitudinal ridge extending substantially the upper length thereof;

a cylindrical sleeve slideably mounted on said horizontal tube, said sleeve having a transverse channel at the top thereof, said channel communicating with said horizontal tube, said channel adapted to receive and retain locking means, said locking means when engaged with said tube and said upper ridge securing said sleeve to said horizontal tube;

said locking means comprising a knobbed clasp bolt, flanged clasp and opposing threaded flanged clamp, said clamps mounted on said bolt and said clamps situated on a horizontal plane on opposing sides of said horizontal tube and said upper ridge; and said sleeve further having attachment means situated thereon for securing said sleeve to said stump rest panel.

2. A strump rest as defined by claim 1 wherein said horizontal tube is provided with two longitudinally extending ridges.

3. A strump rest as defined by claim 1 wherein said stump rest panel is padded.

4. A stump rest as defined by claim 1, wherein said securing means comprises:

at least two spaced-apart plates attached to said vertical tube of said stump rest;

openings through each of said plates for receiving and retaining locking means;

a corresponding number of compatibly spaced-apart plates attached to the leg of said wheel chair on which said stump rest is to be mounted; and locking means attached to the upper surfaces of said leg plates for engagement with said openings in the corresponding plates on said vertical tube.

* * * * *